US005927998A

United States Patent [19]

Hino et al.

[11] Patent Number: 5,927,998

[45] Date of Patent: Jul. 27, 1999

[54] SOCKET FOR MINIATURE LAMP

[75] Inventors: Kiyokazu Hino; Shuuzou Yamamoto, both of Ehime-ken, Japan

[73] Assignee: Harison Denki Co., Ltd., Ehime-ken, Japan

[21] Appl. No.: 08/784,717

[22] Filed: Jan. 16, 1997

[30] Foreign Application Priority Data

Oct. 9, 1996 [JP] Japan ..... 8-011671

[51] Int. Cl.[6] ..... H01R 9/09

[52] U.S. Cl. ..... 439/57

[58] Field of Search ..... 439/57, 86, 544, 439/546, 547

[56] References Cited

U.S. PATENT DOCUMENTS 4,299,430 11/1981 Baba et al. ..... 439/57

4,934,951 6/1990 Schonath ..... 439/57

FOREIGN PATENT DOCUMENTS 3-661847 6/1991 Japan .

3-274657 12/1991 Japan .

7-272807 10/1995 Japan .

*Primary Examiner*—Steven L. Stephan

*Assistant Examiner*—Eugene G. Byrd

*Attorney, Agent, or Firm*—Knobbe, Martens, Olson & Bear, LLP

[57] ABSTRACT

A miniature lamp socket is formed such that a tip portion is not brought into contact with the inner wall of the bottom of a lamp-installing hole, and lead-wire guide grooves communicating with lead-wire insertion holes extend in the forward and rearward directions opposite to each other as seen from the front of a filament. The miniature lamp socket has projection pieces for improving vibration-resistance.

4 Claims, 8 Drawing Sheets

SOCKET FOR MINIATURE LAMP

BACKGROUND OF THE INVENTION

1. Field of the Invention

This invention relates to a miniature lamp socket which is used for a miniature lamp device suitable for use as a light source for display of automobile instruments or the like, for instance.

2. Description of the Prior Art

A description will now be given of a miniature lamp socket of this type in a prior art with reference to FIG. 15. The miniature lamp socket in the prior art has a bottomed base body 2 of a substantially cylindrical shape, a flange (collar) 3 set up around the outer wall of the cylindrical bottomed base body 2, and a projection 4 projecting from the flange 3 downwards, and the cylindrical bottomed base body 2, the flange 3 and the projection 4 are formed as one body by the use of a synthetic resin. A lower portion of the cylindrical bottomed base body 2 has a reduced-diameter and forms a tip-installing hole 8 for a miniature lamp 5 having a tip portion 21. Lead-wire insertion holes 9, 9 are provided in the bottom of the cylindrical bottomed base body 2 so as to vertically extend through the bottom thereof, and a pair of lead-wire guide grooves 11, 11 communicating with the lead-wire insertion holes 9, 9 are formed in alignment with each other on the lower surface of the flange 3.

After lead wires 10, 10 of the miniature lamp 5 installed in the cylindrical bottomed base body 2 are respectively inserted into the lead-wire insertion holes 9, 9, and are drawn out from the lower surface of the flange 3, the drawn-out lead wires 10, 10 are further drawn out from the upper surface of the flange 3 through the lead-wire guide grooves 11, 11 provided in a concave shape on both left and right sides of the flange, and are caused to pass along the upper surface of the flange 3. Thereafter, the ends of the lead wires 10, 10 are fixed by means of squeezing or the like to lead-wire fixing grooves (not shown) provided on the lower surface of the flange 3.

Japanese Utility Model Laid-open No. 3-66184 has disclosed an invention, in which the bottom of a lead-wire fixing groove is inclined to make it hard to come off the end of a lead wire from the lead-wire fixing groove. According to this disclosed invention, since the lead wire is arranged such as to be bifurcated to the left and right as seen from the front of the miniature lamp, a seal portion of the miniature lamp is easily broken. Further, since the lead wire is bifurcated from the seal portion of the lamp to the left and right, the lead wire comes off from the lead-wire fixing groove due to vibrations or the like when the bifurcated portions of the lead wire tend to be restored to its linear shape. In order to prevent such a defect, a lead-wire fixing projection is provided opposite the lead-wire fixing groove so as to stably fix the lead wire to the lead-wire fixing groove by squeezing the projection.

There have been demands for lamps used for a display panel such as an instrument panel to further reduce the size. Therefore, in order to meet the demands for more miniature displays, it is necessary for the miniature lamp socket in the prior art to shorten the distance from the bottom of the cylindrical bottomed base body 2 to the top of a bulb as much as possible. In this connection, the miniature lamp socket in the prior art has the following problems. One of the problems is that when a glass bulb 19 is deeply inserted into the socket 1, a tip portion 21 provided on the lower end of the glass bulb 19 is brought into contact with the bottom of the cylindrical bottomed base body 2, and as a result, the tip portion is broken. Another problem is that since the lead wires 10, 10 are drawn out from the seal portion 20 toward both the left and right sides, tensile force acts on the seal portion 20, and as a result, the seal portion 20 is broken. A further problem is that since power is fed by holding a printed circuit board between the flange 3 and the projection 17, the printed circuit board and the miniature bulb device become loose so as to separate from each other through rotation depending on the conditions of use including vibrations or the like, and as a result, a defective lighting is caused.

In case of using a miniature lamp of a wedge base type (See Japanese Patent Laid-open No. 3-274657, for instance) structured such that a receiving terminal is arranged along the outer surface of a squeezed seal portion as shown in FIGS. 16 to 19, the following problems are posed. Namely, when such a miniature lamp is installed in the socket as shown in FIG. 18, the receiving terminal is moved in a horizontal direction to cause a defective contact. Otherwise, the lamp sometimes falls off from the socket in case of installing the lamp in the socket.

Further, the miniature lamp socket as disclosed in Japanese Utility Model Laid-open No. 3-66184 is defective in that since the lead wires are fixed to the read-wire fixing grooves by squeezing the projections, such a squeezing operation produces the vibration of the socket.

SUMMARY OF THE INVENTION

It is an object of the present invention to reduce restoring force of lead wires by arranging the lead wires in the forward and rearward directions opposite to each other as seen from the front of a lamp, and to enable the lead wires to be stably fixed to lead-wire fixing grooves by bending the lead wires and then causing the bent lead wires to extend along the bottom of the read-wire fixing grooves without squeezing projections or the like.

According to the present invention, support portions are provided between a lamp-installing hole and a tip-installing hole, which are provided in a cylindrical bottomed base body, so as to prevent a tip portion from being brought into contact with the bottom of the cylindrical bottomed base body when a miniature lamp having a tip is installed. Further, a bulb is supported by the support portions such that the tip portion is located above the bottom of the cylindrical bottomed base body, and lead wires and a flange are connected without using a connection piece including a metal member or the like.

According to the present invention, lead-wire guide grooves communicating with lead-wire insertion holes are provided in a concave shape on the lower surface of the flange in the forward and rearward directions opposite to each other such that the lead wires drawn out from the lower surface of the flange are disposed in the forward and rearward directions opposite to each other. The lead wires are passed through the lead-wire guide grooves, and are fixed in a bent state to recess grooves provided on the edge of the flange.

According to the present invention, projection pieces including an elastic member are mounted on the flange of the miniature lamp device so as to prevent the miniature lamp device from getting loose relatively to a printed circuit board, since the projections on the flange are restored to their original positions and are placed in the locked state after the projections are bent, in a case where the miniature lamp device is mounted on the printed circuit board by rotating the miniature lamp device in a certain direction.

According to the present invention, each lead-wire fixing groove provided on the lower surface of the flange has an inclined bottom which gradually becomes deeper from the side of an outer edge of the flange.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENT

Figure 1:
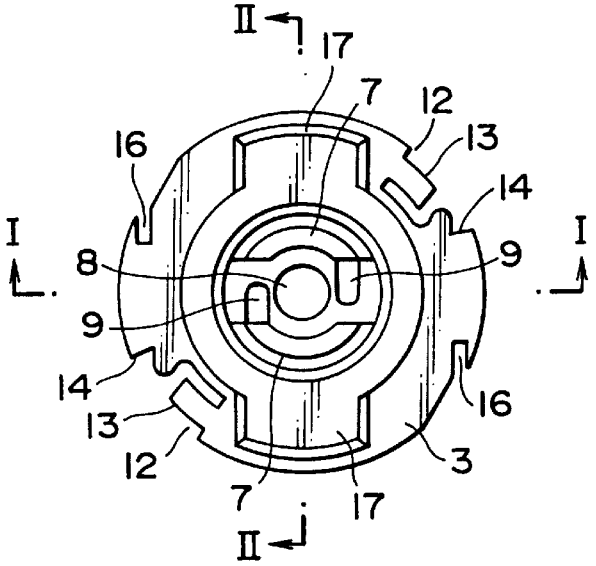
FIG. 1 is a plan view showing a miniature lamp socket.
Figure 2:
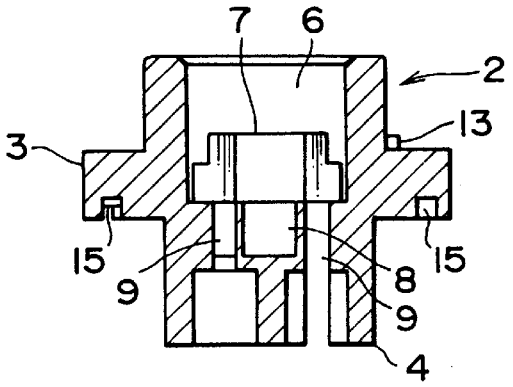
FIG. 2 is a sectional view taken along a line I—I in FIG. 1.
Figure 3:
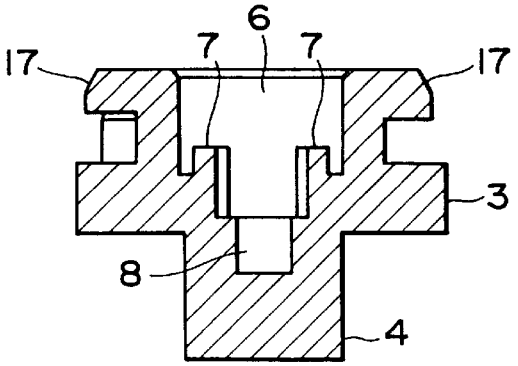
FIG. 3 is a sectional view taken along a line II—II in FIG. 1.
Figure 4:
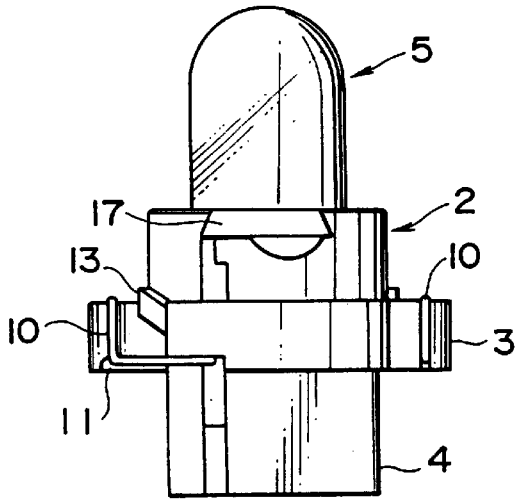
FIG. 4 is a front view showing a miniature lamp installed in a miniature lamp socket.
Figure 5:
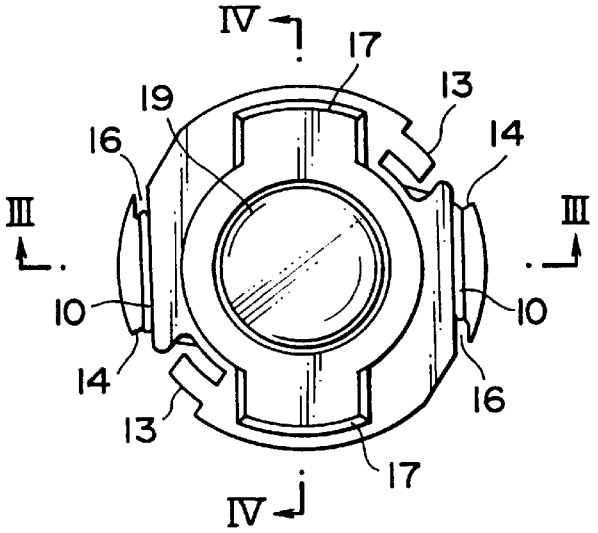
FIG. 5 is a plan view of FIG. 4.
Figure 6:
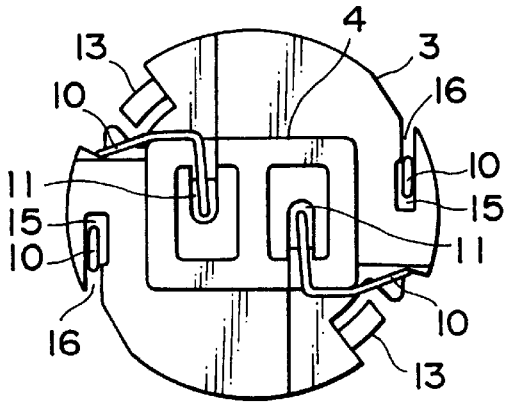
FIG. 6 is a bottom view of FIG. 4.
Figure 7:
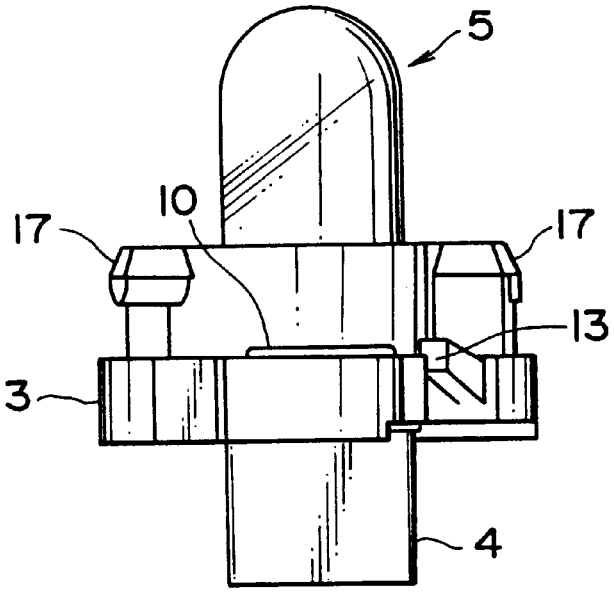
FIG. 7 is a right side view of FIG. 4.
Figure 8:
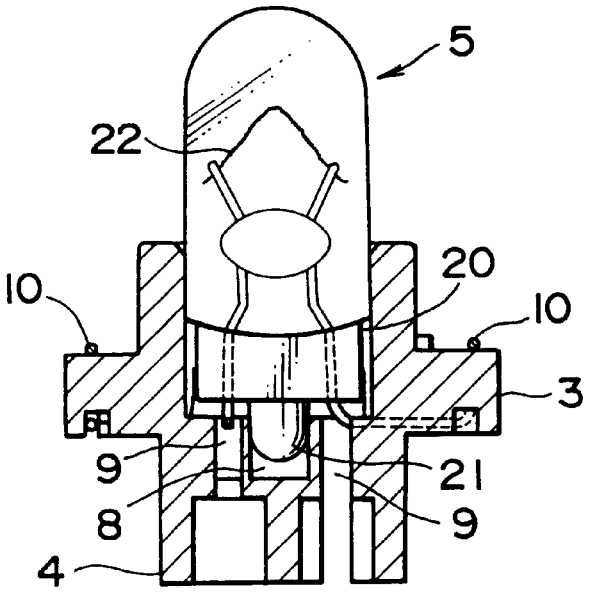
FIG. 8 is a sectional view taken along a line III—III in FIG. 5.
Figure 9:
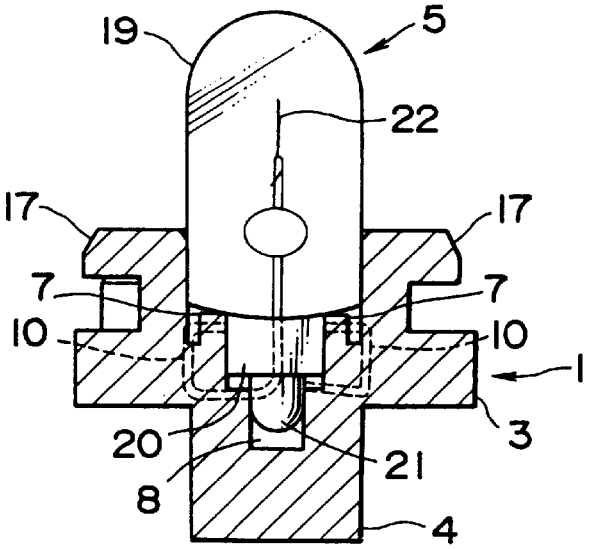
FIG. 9 is a sectional view taken along a line IV—IV in FIG. 5.

A lamp socket 1 shown in FIGS. 1 to 13 comprises a bottomed base body 2 of a substantially cylindrical shape, a flange 3 set up around the outer edge of the bottom of the cylindrical bottomed base body 2, and a projection 4 projecting from the lower side of the bottom of the cylindrical bottomed base body 2 downwards. The cylindrical bottomed base body 2, the flange 3 and the projection 4 are formed as one body by the use of a thermoplastic and insulating synthetic resin.

The cylindrical bottomed base body 2 has a lamp-installing hole 6 having an open top so as to install a miniature lamp 5 into the cylindrical bottomed base body. The upper end of the lamp-installing hole 6 is larger in inner diameter than the other portion. Circular arc-shaped support portions (inner support projections) 7, 7 are provided along a wall of a lower portion of the lamp-installing hole 6, and are structured such that portions of a concave shape confront each other and the inner wall surface forms a step portion as seen from the side. A portion below the support portions 7, 7 has a reduced-diameter, and forms a tip-installing bottomed hole 8 of a circular plane.

Lead-wire insertion holes 9, 9 are provided in the bottom of the cylindrical bottomed base body 1 so as to vertically extend through the bottom thereof. Lead-wire guide grooves 11, 11 for guiding lead wires 10, 10 toward the outer edge of the flange 3 are provided in a concave shape on the projection 4 so as to communicate with the lead-wire insertion holes 9, 9. The lead wire guide grooves 11, 11 are positioned in parallel to each other so as to respectively extend from openings of the lower ends of the lead-wire insertion holes 9, 9 toward the forward and rearward directions opposite to each other.

Figure 11:
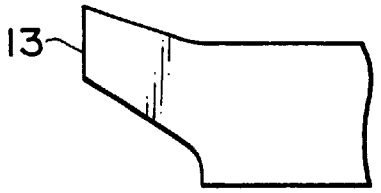
FIG. 11 is a view for explaining a projection piece.
Figure 12:
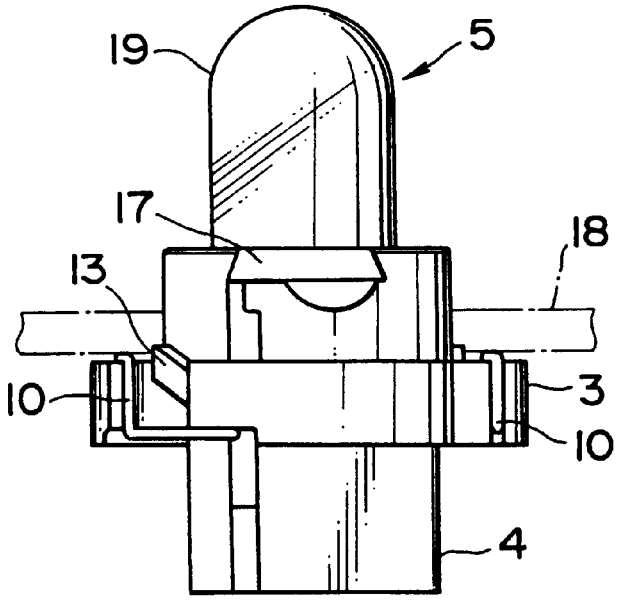
FIG. 12 is a front view showing a miniature lamp device mounted on a printed circuit board.
Figure 13:
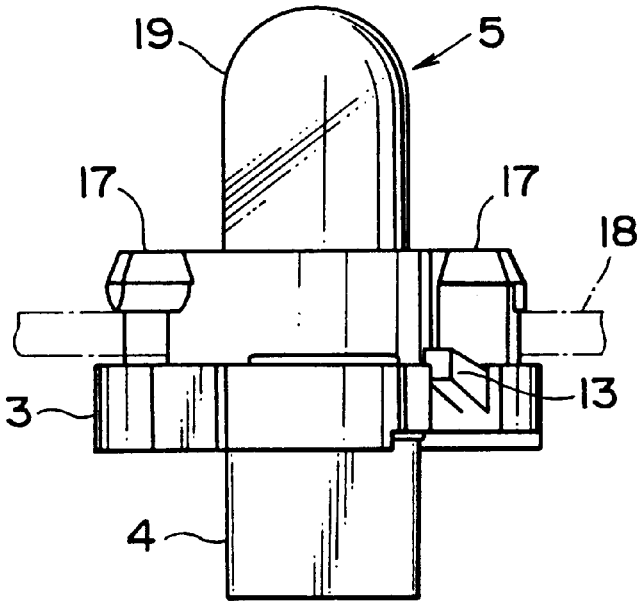
FIG. 13 is a right side view of FIG. 12.

The flange 3 is integrally provided on the outer wall of the bottom of the cylindrical bottomed base body 1 so as to extend at right angles with the outer wall thereof. Recess grooves 12, 12 are formed by recessing the flange 3 from its peripheral edge toward the outer ends of the lead-wire guide grooves 11, 11 so as to have point-symmetrical relation with each other. Projection pieces 13, 13 including an elastic member such as nylon, for instance, are respectively mounted on the walls of the recess grooves 12, 12 so as to extend slightly upwards and also to face in the same circumferential direction, as shown in FIG. 11.

Figure 10:
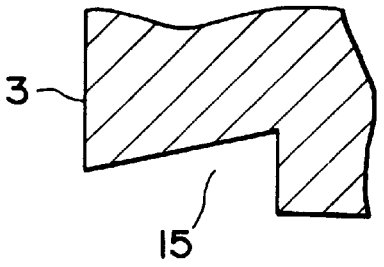
FIG. 10 is a longitudinal sectional view showing an essential portion of a lead-wire fixing groove.

Lead-wire insertion grooves 14, 14 are formed in the vicinity of the recess grooves 12, 12 by slightly recessing the flange 3 toward its inner side. Lead-wire fixing grooves 15, 15 parallel to the lead-wire guide grooves 11, 11 are formed on the lower surface of the flange 3 so as to communicate with the lead-wire insertion grooves 16, 16. The bottoms of the lead-wire fixing grooves 15, 15 are respectively inclined so as to gradually become deeper from the side of the lead-wire insertion grooves 16, 16, as shown in FIG. 10.

Projections 17, 17 are provided on an outer wall of an upper portion of the cylindrical bottomed base body 2 so as to extend in the same direction as the lead-wire guide grooves 11, 11, and a printed circuit board 1 may be held by the flange 3 and the projections 17, 17.

A description will now be given of a method for installing a miniature lamp in the miniature lamp socket described above. Firstly, the miniature lamp 5 having a tip portion 21 extending from a seal portion 20 provided on the lower end of a bulb 19 is installed in the lamp-installing hole 8 provided inside the cylindrical bottomed base body 2. Subsequently, the lead wires 10, 10 are inserted into the lead wire insertion holes 9, 9 from their upper openings, i.e., the inside openings of the bottom, and are drawn out from the openings of the lead-wire insertion holes 9, 9 on the outer side of the bottom toward the lower side of the flange 3. The drawn-out lead wires 10, 10 are bent forward and rearward as seen from the front of a filament 22, and are passed through the lead-wire guide grooves 11, 11. Then, the lead wires 10, 10 are bent from the front and rear edges of the lead-wire insertion grooves 14, 14, which are formed by recessing the projections 4, toward both the left and right sides. After the bent lead wires 10, 10 are caused to extend along the outer walls of the projections 4 toward the lead-wire insertion grooves 14, 14, the lead wires 10, 10 are drawn out from the upper surface of the flange 3 through the lead-wire insertion grooves 14, 14. Further, the lead wires 10, 10 are caused to extend along the upper surface of the flange 3 toward the lead-wire insertion grooves 16, 16, and are then inserted into the lead-wire insertion grooves 16, 16. The inserted lead wires 10, 10 are drawn out from the lower surface of the flange 3, and are bent. Then, the bent lead wires 10, 10 are fixed to the bottom of the lead-wire fixing grooves 15, 15 so as to be brought into contact therewith.

When the miniature lamp device installed in the lamp socket is inserted into a socket mounting hole of the printed circuit board 18 and are rotated in the mounting direction, the printed circuit board 18 is held by the flange 3 and the projections 17, 17. The miniature lamp device is mounted on the printed circuit board 18 by rotating the miniature lamp device from the base portion of the projection piece 13 toward its upper end. Since the projection pieces 13 are directed not to separate from the printed circuit board, the lamp socket 1 is not rotated in the reverse direction after the miniature lamp device is mounted on the printed circuit board. Thus, the lamp socket may be fitted to the printed circuit board 18 without falling off therefrom. The lead wires 10, 10 mounted across the flange 3 are brought into contact with a conductive layer of the printed circuit board 18, and power is fed to the lead wires to turn on the miniature lamp 5.

Figure 14:
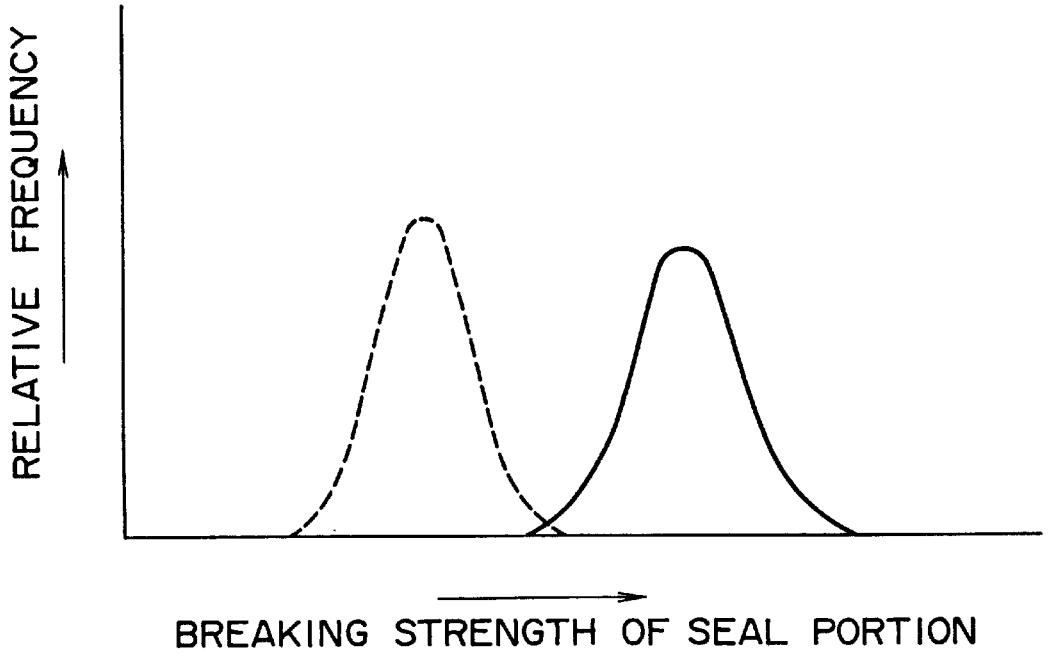
FIG. 14 is a graph showing the distribution of the breaking strength of a seal portion on the basis of the drawing direction of lead wires.
Figure 15:
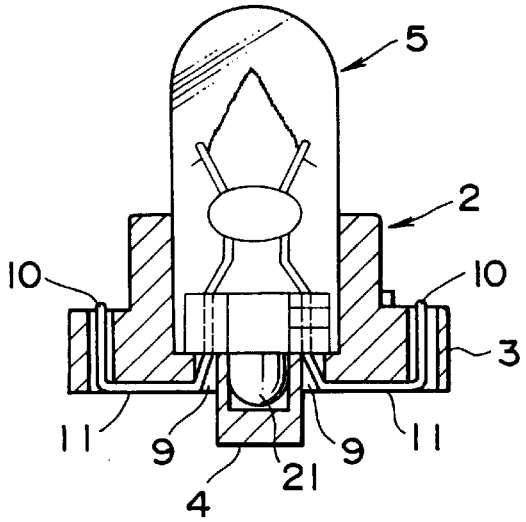
FIG. 15 PRIOR ART
FIG. 15 is a longitudinal sectional view showing a prior art.
Figure 16:
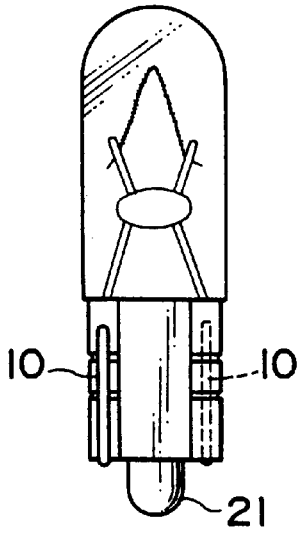
FIG. 16 PRIOR ART
FIG. 16 is a view for explaining a lamp of wedge base type in a prior art.
Figure 17:
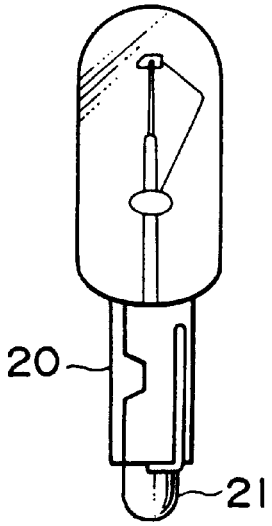
FIG. 17 PRIOR ART
FIG. 17 is a side view of FIG. 15.
Figure 18:
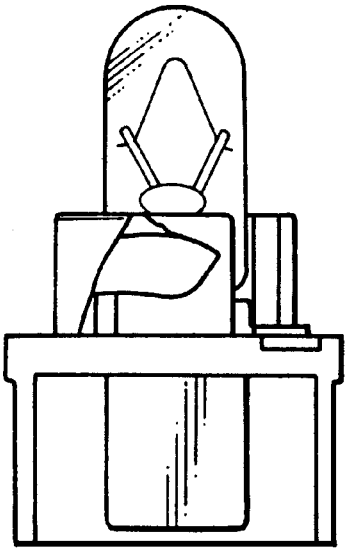
FIG. 18 PRIOR ART
FIG. 18 is a view for explaining the lamp of wedge base type of FIG. 15 installed in a socket.
Figure 19:
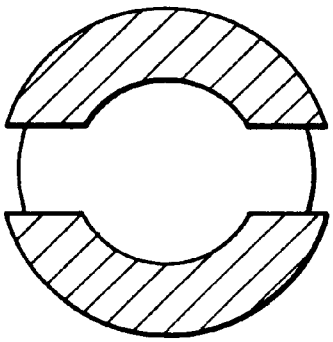
FIG. 19 PRIOR ART
FIG. 19 is a plan view showing an essential portion of a lamp-installing hole of a miniature lamp socket in a prior art.

FIG. 14 shows the breaking strength of a bulb seal portion on the basis of the drawing direction of the lead wires. In FIG. 14, a solid line shows the distribution of the tensile strength of a miniature bulb in case of drawing the lead wires in the forward and rearward directions opposite to each other as seen from the front of the filament, and a dotted line shows the distribution of the tensile strength of a miniature bulb in case of drawing the lead wires in the left and right directions as seen from the front of the filament. As is apparent from this drawing, the miniature lamp in case of drawing the lead wires in the forward and rearward directions opposite to each other as seen from the front of the filament is lower in load applied to the seal portion, and shows low breaking strength.

The present invention shows the following effects. Namely, since the support portions are provided on the inner wall between the lamp-installing hole and the tip-installing hole to support the bulb such that the tip portion is located above the bottom of the cylindrical bottomed base body without being brought into contact with the bottom thereof, it is possible to provide a miniature lamp device, which may not occur the breakage of the tip portion, and reduces a variation of filament position on the printed circuit board.

In addition, since the lead wires are bent at a predetermined distance from the seal portion in the forward and rearward directions opposite to each other, and the ends of the lead wires are only bent for fixing, there is no possibility that the seal portion is broken to fall off a miniature lamp from the socket. Besides, it is possible to provide a miniature lamp, which may be arranged at a low position, and enables to easily fix the lead wires without using any metal connection piece.

Further, since the projections are provided on the flange, there is no possibility that the miniature lamp device is rotated so as to separate from the printed circuit board to result in defective conduction of electricity from the printed circuit board, and therefore, it is possible to improve vibration-resistance.

Furthermore, since the present invention is applied to an already-existing display, it is possible to reduce the number of parts, and to provide an economical miniature bulb device, which shows satisfactory efficiency of production.

What is claimed is:

1. A miniature lamp socket for installing a miniature lamp comprising a bulb and a bottom provided with a seal portion, a tip portion, and two lead wires, said miniature lamp socket comprising:

a cylindrical-bottomed base body provided with a lamp-installing hole having a bottom, an inner circumferential surface, and an open top to install a miniature lamp therein, a tip-installing hole for fitting the tip portion of the miniature lamp therein, said tip-installing hole formed at the bottom of said lamp-installing hole, a flange for installation of said miniature lamp socket, said flange formed outward at the bottom of said cylindrical-bottomed base body, said flange having a lower circumferential surface and an upper circumferential surface, a pair of lead-wire insertion holes through which the lead wires of the miniature lamp pass when installed, said pair of lead-wire insertion holes formed at the bottom of said lamp-installing hole, lead-wire guides formed on the lower circumferential surface of said flange and extending to the upper circumferential surface of said flange to hook to the flange the lead wires led from said lead-wire insertion holes and to make the lead wires on the upper circumferential surface of said flange in direct and electrical contact with an external connecting point, when the socket is installed, said lead-wire guides extending from the two lead-wire insertion holes in opposite directions, each substantially perpendicular to an axis passing through the two lead-wire insertion holes, and the two lead wires are hooked to the flange in opposite directions, and inner support projections formed at the bottom of and within said lamp-installing hole, for supporting the seal portion of the miniature lamp;

wherein the miniature lamp is supported, when positioned, by said inner circumferential surface, said tip-installing hole, said inner support projections, and the lead wires.

2. A miniature lamp socket according to claim 1, wherein said flange has two cut-out portions at diagonal positions, each cut-out portion forming a projection piece which is bendable in a perpendicular direction and is angled with respect to the upper circumferential surface of the flange.

3. A miniature lamp socket according to claim 1, wherein said lead-wire guides extend from said lead-wire insertion holes to the lower and upper circumferential surfaces of the flange, and further extend to the lower circumferential surface where the respective ends of the two lead wires are hooked, wherein the hooking points on the lower circumferential surface of the flange is recessed to securely fasten the ends of the two lead wires.

4. A miniature lamp socket according to claim 2, wherein said lead-wire guides extend from said lead-wire insertion holes to the lower and upper circumferential surfaces of the flange, and further extend to the lower circumferential surface where the respective ends of the two lead wires are hooked, wherein the hooking points on the lower circumferential surface of the flange is recessed to securely fasten the ends of the two lead wires.

* * * * *